United States Patent [19]

Dale

[11] Patent Number: 4,948,380

[45] Date of Patent: Aug. 14, 1990

[54] DUAL CONTACT ELECTRICAL TERMINAL

[75] Inventor: James L. Dale, Atlanta, Ga.

[73] Assignee: AMP Incorporated, Harrisburg, Pa.

[21] Appl. No.: 416,294

[22] Filed: Oct. 2, 1989

[51] Int. Cl.[5] ..... H01R 4/24

[52] U.S. Cl. ..... 439/395

[58] Field of Search ..... 439/391–426

[56] References Cited

U.S. PATENT DOCUMENTS

| | | | |
|---|---|---|---|
| 3,910,671 | 10/1975 | Townsend | 339/97 R |
| 4,283,104 | 8/1981 | Pemberton | 439/395 |
| 4,806,119 | 2/1989 | Herfort et al. | 439/395 |

*Primary Examiner*—Joseph H. McGlynn

*Attorney, Agent, or Firm*—Robert W. Pitts

[57] ABSTRACT

Cable tap assembly for selectively connecting tap conductors to cable wire conductors comprises a housing having a cable wire locator for locating the cable wires in predetermined coplanar positions. A plurality of bus conductors are provided in the housing and extend parallel to the cable wires with each bus conductor being dedicated to, and associated with, a single cable wire. The bus conductors have receptacle sites which are accessible from the exterior of the housing so that terminals can be mated with the bus conductors. Connecting devices extend from the bus conductors to the cable wires. Connecting devices for use with power wires have parallel legs with quick disconnect ears on the edge of one leg adjacent the center of the terminal and aligned insulation displacement slots in the ends of each leg forming parallel current carrying paths.

9 Claims, 14 Drawing Sheets

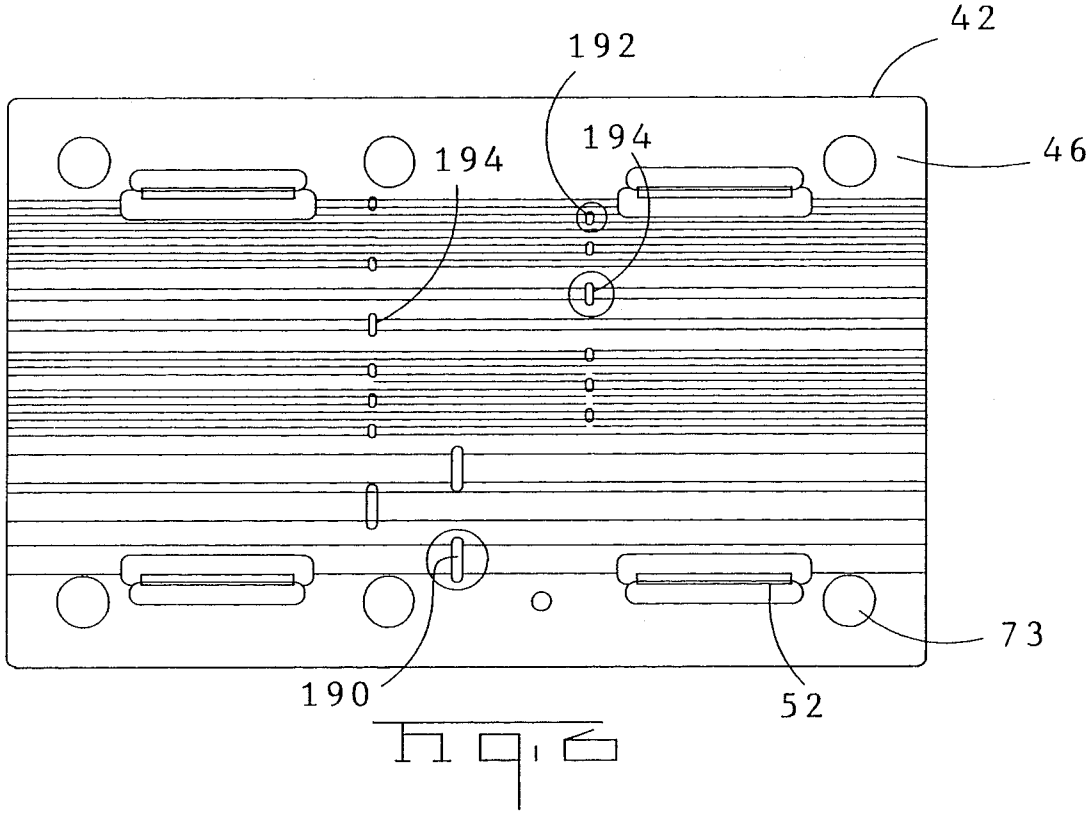
42
46
192
194
194
73
52
190

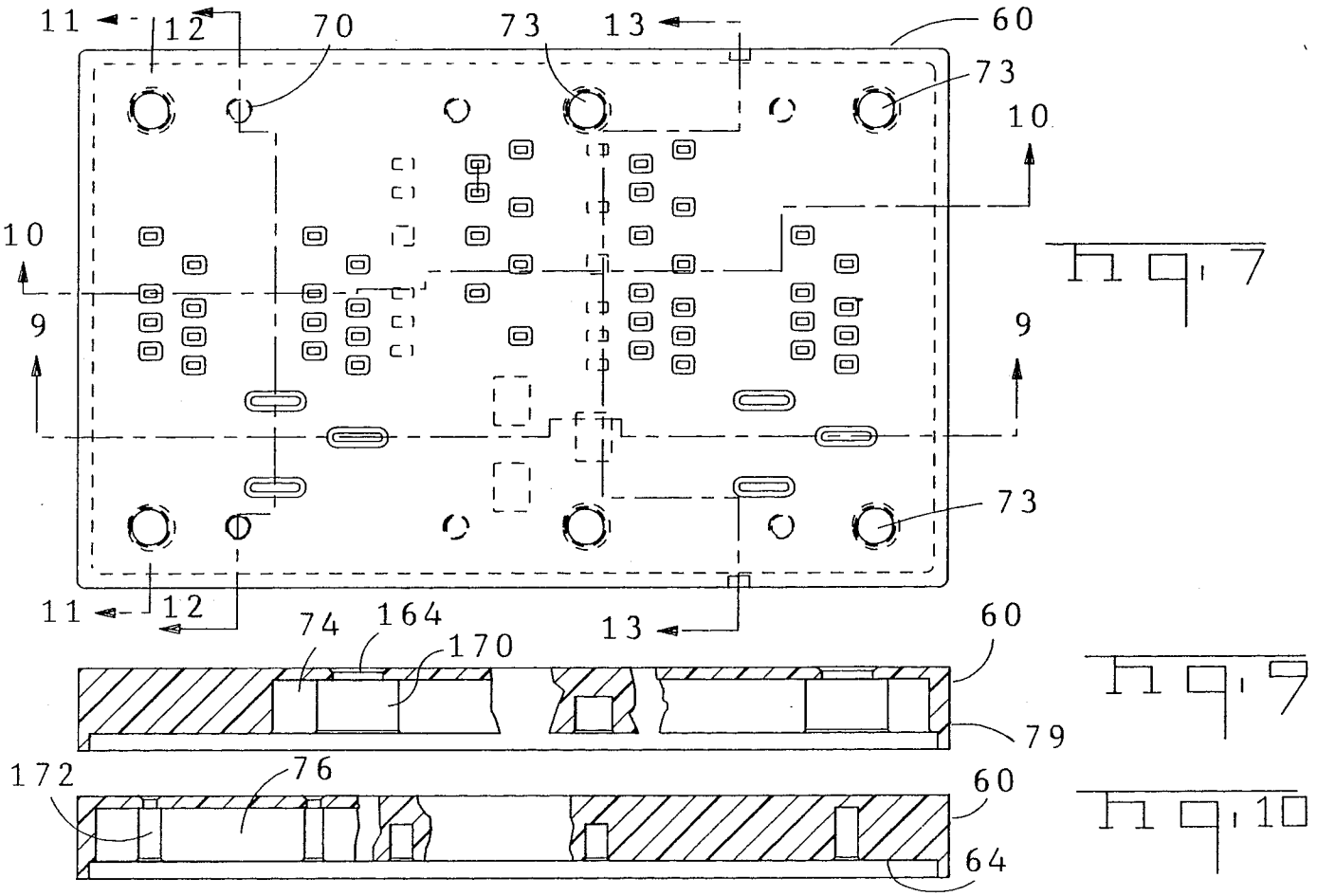
7
9
10
60
73
13
70
12
11
79
64
170
164
74
76
172

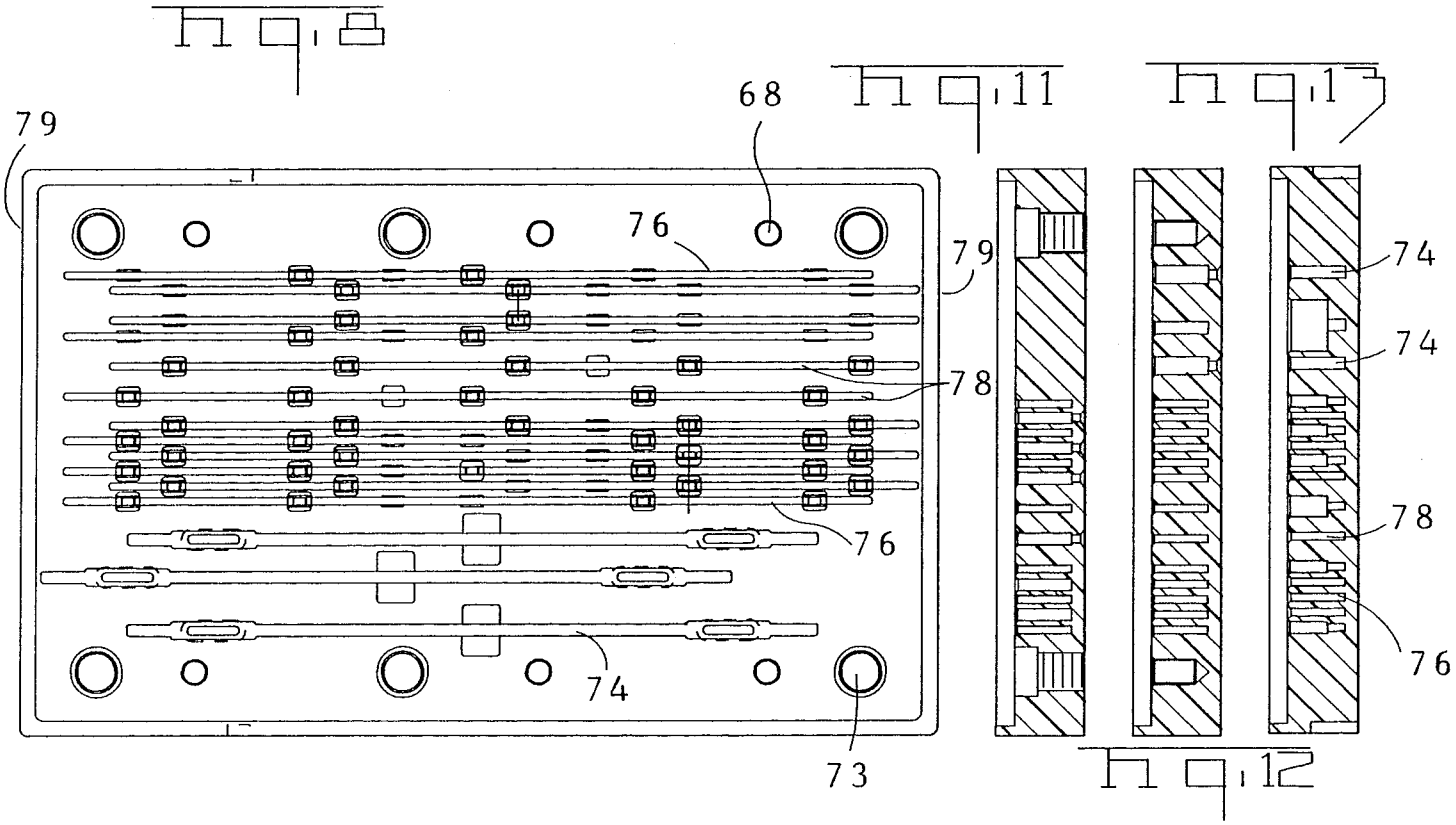
74
74
78
76
11
12
79
78
76
73
68
76
74
79
15

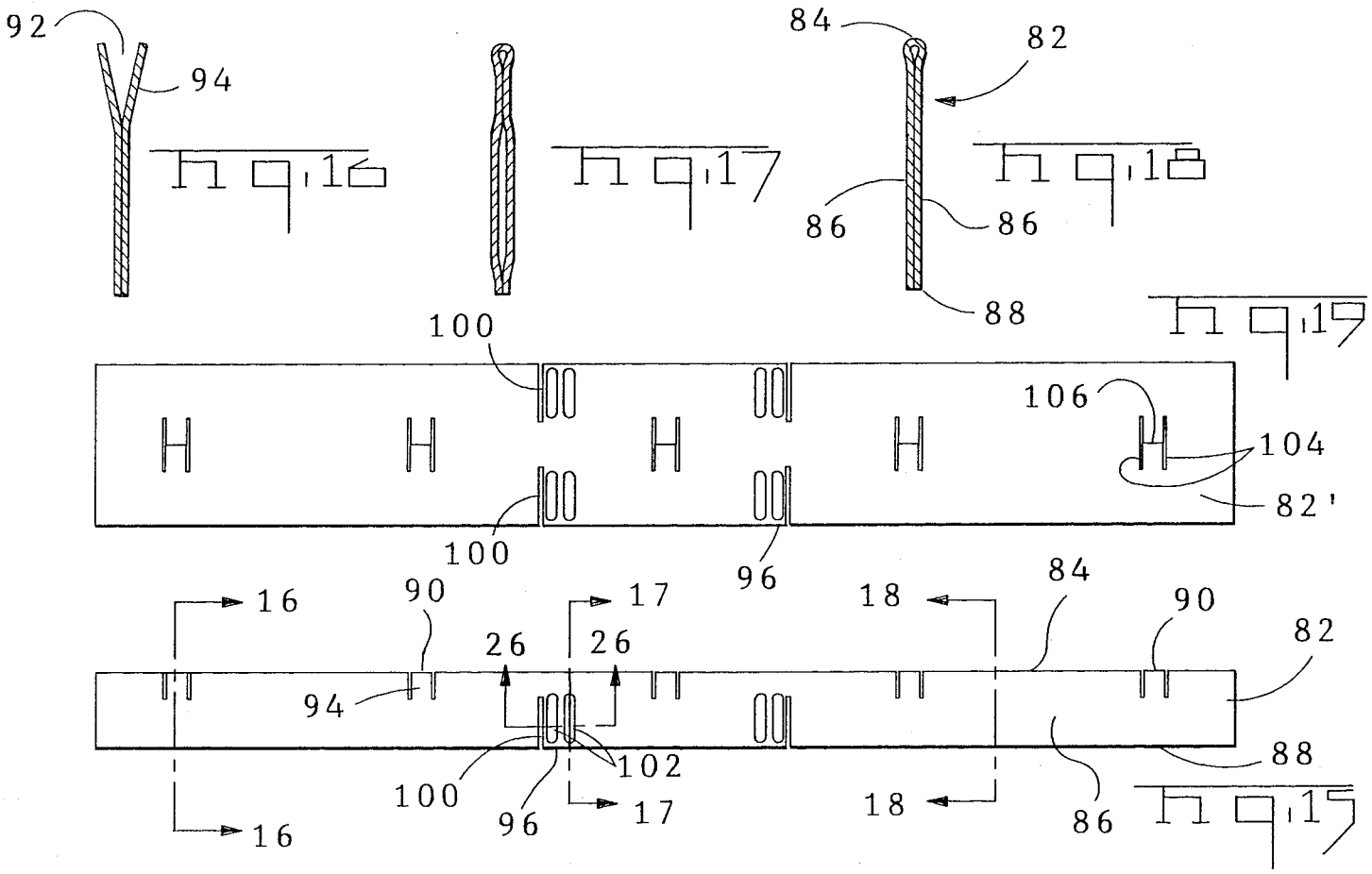
82
84
86
86
88
94
92
100
100
96
106
104
82'
17
17
16
16
18
18
26
26
102
96
100
90
94
90
84
86
82
88

DUAL CONTACT ELECTRICAL TERMINAL

BACKGROUND OF THE INVENTION

1. Field of the Invention

This invention relates to the use of quick disconnect electrical terminations in the form of arcuately formed ears and insulation displacement terminations on the same electrical terminal.

2. Description of the Prior Art

Quick disconnect terminations and insulation displacement terminations comprise reliable means for establishing solderless electrical terminations. The use of these conventional terminations on a single terminal is demonstrated by U.S. Pat. No. 3,910,671 in which arcuately formed ears are located along the edges of legs with a slot being formed in each leg of a U-shaped electrical terminal. Even though quick disconnect terminations and insulation displacement terminations are each quite reliable, the fact that the terminations themselves have substantially the same current carrying capacity, does not mean that the terminal will have the same current carrying capacity as the terminations. If the current carrying path between the two terminations is restricted, then the capacity of the terminal will be less than that of the terminations themselves. Where large currents on the order of 15 and 20 amps must be carried, local restrictions in the current carrying path can cause hot spots and unacceptable temperature rise. Where other limitations, such as space availability and manufacturing limitations, are encountered, the cross sectional area available for carrying current between the two terminations can be unacceptably low.

SUMMARY OF THE INVENTION

Parallel current carrying paths between a quick disconnect termination with a planar member or blade and insulation displacement terminations to a wire when the power terminals depicted herein are used to interconnect a bus conductor and wires in a cable. Reliable terminations can be made to power conductors carrying 15 or 20 amps using this terminal. Quick disconnect ears are formed by arcuately bending lateral segments located adjacent the center of a blank upwardly so that the edges are juxtaposed to one face of the terminal. The blank is reversely bent at the center to form two parallel legs. Insulation displacement slots are formed in the ends of each of the legs with the slots in alignment so that each engages the same wire. The ends of the legs are pointed so that the terminal will penetrate the insulation of a cable when the terminal is forced over the wire in the cable to form the insulation displacement termination. Each of the legs forms a parallel current carrying path between the quick disconnect ears and the insulation displacement slots. Since the quick disconnect ears extend from the edges of one leg and the slots extend inwardly from the end of each leg, the legs can have a constant width between the two terminations and there will be no restriction in either of the two parallel current carrying paths.

BRIEF DESCRIPTION OF THE DRAWINGS

FIG. 3 is a plan view showing the locations of connectors coupled to the cable tap assembly.

FIG. 5 and 6 are views looking in the direction of the arrows 5—5 and 6—6 of FIG. 4.

FIG. 7 is a top plan view of the bus conductor housing body.

FIG. 8 is a plan view of the underside of the bus conductor housing body.

FIGS. 9, 10, 11, 12, and 13 are sectional views looking in the directions of the correspondingly numbered arrows of FIG. 7.

FIG. 15 is a side view of one of the bus bars which are contained in the bus housing.

FIG. 16, 17, and 18 are views looking in the directions of the correspondingly numbered arrows in FIG. 15.

FIG. 19 is a plan view of the blank from which the bus bar of FIG. 15 is formed.

FIG. 23 is a plan view of the blank from which the bus bar of FIG. 20 is formed.

FIG. 31 is a fragmentary view of a portion of the bus bar of FIG. 15 showing a male tab terminal inserted into a receptacle site and showing a connecting device coupled to the bus bar.

FIG. 32 is a view looking in the direction of the arrows 32—32 of FIG. 31.

FIG. 33 is a view similar to FIG. 32 but showing the positions of the parts prior to insertion of the tab terminal.

FIG. 34 is a schematic view of an alternative embodiment which has the capability of splicing the ends of two cables.

DETAILED DESCRIPTION OF THE PREFERRED EMBODIMENT

Figure 1:
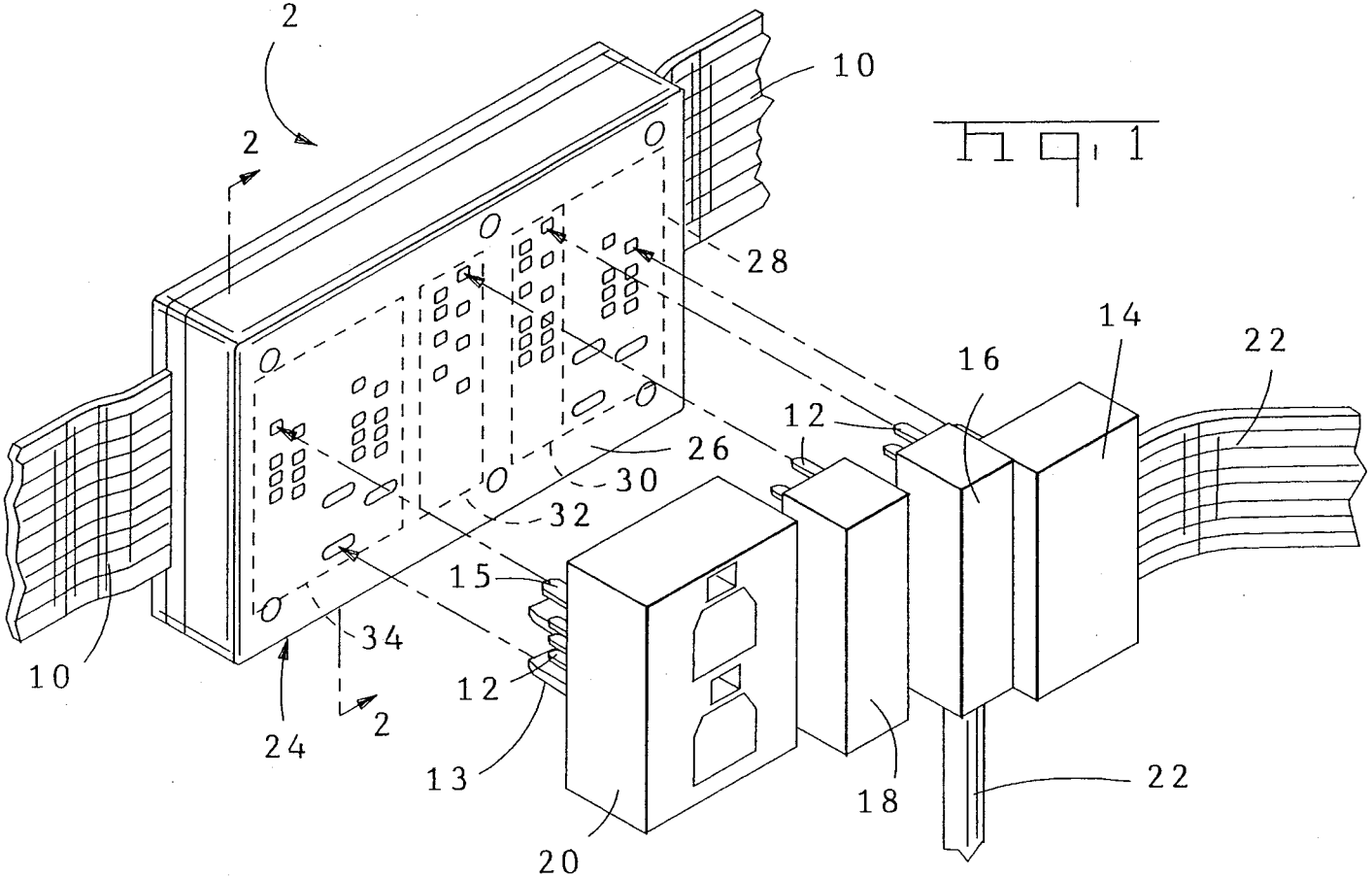
FIG. 1. is a perspective view of a cable tap assembly in accordance with the invention.
Figure 2:
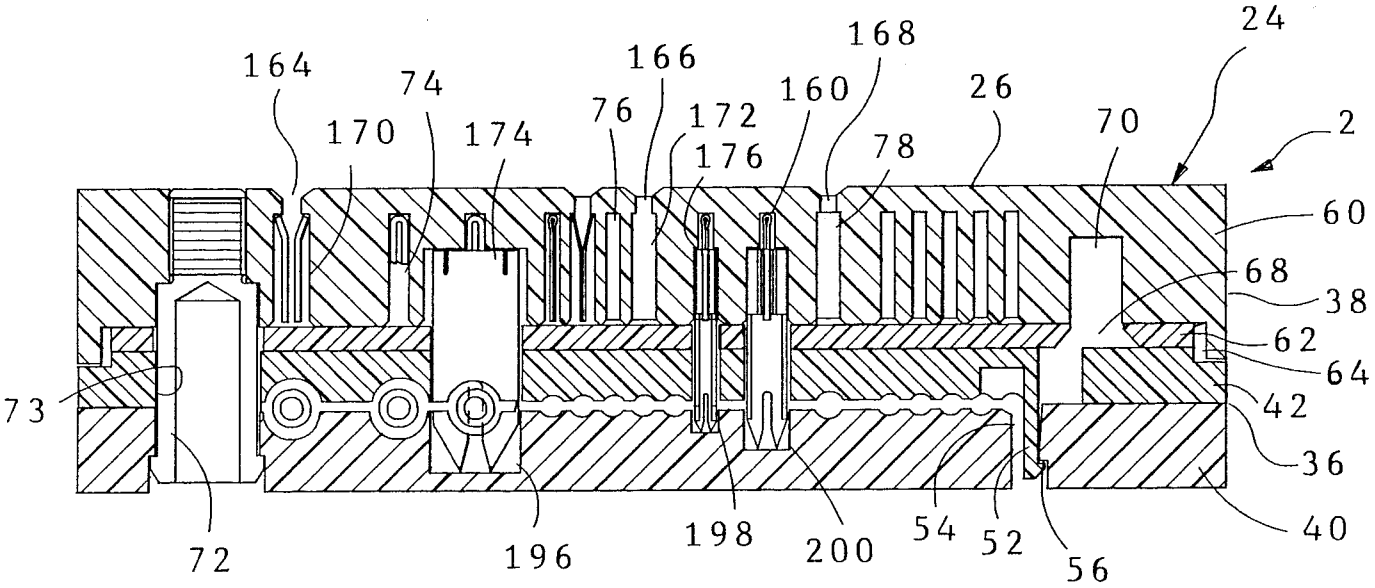
FIG. 2 is a sectional view taken along an irregular section line 2—2 in FIG. 1.

A cable tap connector assembly 2 in accordance with the invention, FIGS. 1–3, serves to connect male terminals 12, 13, 15 contained in connectors 14, 16, 18, 20 to wires 4, 6, 8 which are contained in a cable 10. The cable 10 (FIG. 4) has three relatively coarse wires 4, relatively fine gauge wires 6, and two wires 8 of intermediate gauge. A cable of this type might be used in the wiring for a building in which case the wires 4 would be power supply wires, the wires 6 could be control circuits and the intermediate gauge wires 8 might be part of an uninterrupted power system. The connectors 14, 16, 18, 20 can be conventional connectors having tap wires extending therefrom and having terminal tabs on the ends of the tap wires. Alternatively, they could contain active devices, for example, controlling devices for controlling appliances or apparatus to which the cable conductors extend. The term "connector" is used herein in a broad sense. One or more of the connectors might be a conventional connector having tap wires extending to tab terminals contained in the connector housing, one or more of the connectors may be a housing containing active devices but having no tap wires extending to the housing, and one or more of the connectors may be a hybrid containing an active device and having wires extending to terminals in the connector housing.

The connectors 14, 16, 18, and 20 have terminal tabs 12, 13, and 15 of varying sizes extending therefrom. The tabs 13 which are connected to the coarse gauge conductors are relatively large, the tabs 12 which are connected to the fine gauge conductors wires are relatively small, and the tabs 15 which are to be connected to the wires of intermediate gauge are of intermediate size.

The tap connector assembly 2 comprises a housing assembly 24 which has a major surface 26 which contains separate zones 28, 30, 32, and 34. Each zone receives one of the connectors 14–20 as shown in FIG. 3 and the male tab terminals extending from these connectors are connected to the individual cable wires 4, 6, 8 as will be described below.

The housing assembly 24 is made up of a cable clamping and wire locating subassembly 36 and a bus conductor housing subassembly 38. The cable clamping subassembly, FIG. 4–6, comprises two plate-like sections 40, 42 which have opposed surfaces 44, 46. These surfaces have semi-cylindrical depressions 48 located on the same centers as the conductors in the cable 10 and have diameters which match the diameters of the insulation on the wires in the cable. When the two sections are against each other, the conductors in the cable are firmly clamped in predetermined positions with the web portions 50 of the cable extending between adjacent conductors. The two sections 40, 42 are secured to each other by latch arms 52 which depend from the section 42 and which have latch ears 53 on their ends. The latch arms extend through openings in the lower section 40 and the ears lodge against latch shoulders 56 as shown in FIG. 2. Rectangular openings 58 are provided in the lower section 40 in order to permit inspection of the lower surface of the cable when the assembly has been installed on a cable. It can be determined by inspecting the cable through these openings if the cable is properly positioned in the depressions in the cable clamping sections.

The bus housing subassembly, FIGS. 2 and 7–14, comprises a main housing body 60 and a cover or retaining plate 62 which is fitted into a recess 64 on the underside of the housing body 60. This retaining plate or cover is secured to the main housing body by fasteners which extend through aligned openings 68, 70. The bus housing subassembly and the cable clamping subassembly are secured to each other by a plurality of plastic snap fasteners 72 which extend through aligned openings 73 in the two subassemblies.

The bus bars, which are described below, are contained in parallel slots 74, 76, 78 which extend inwardly from the downwardly facing surface of recess 64, as viewed in FIG. 2, of the housing body 60 and which extend parallel to the major surface. These slots extend between the ends 79 of the housing body 60 but are staggered as shown in FIG. 8 for reasons which will become apparent from the following description. The slots 74 receive bus bars 80 and the slots 76 receive bus bars 82.

When the cable tap connector 2 is placed in service, the coarse gauge wires 4 will carry a relatively high current and the finer gauge wires 6, 8 will carry correspondingly lower currents. The bus bars 80, 82, 160 and the male tab terminals 12, 13, 15 are accordingly dimensioned so that they are suitable for the currents and voltages encountered.

Each of the bus bars 82, FIG. 15, is associated with one of the relatively fine gauge cable wires 6 and comprises a stamped and formed sheet metal member having a bight 84 and coextensive side walls or arms 86 which are against each other or substantially so as shown in FIG. 18. A plurality of receptacle sites 90 are provided in the bight for tab terminals, each site comprising an opening 92 in the bight and divergent ears 94 which function as a guide or lead-in for the tab when it is inserted into the space between the side walls 86.

Figure 26:
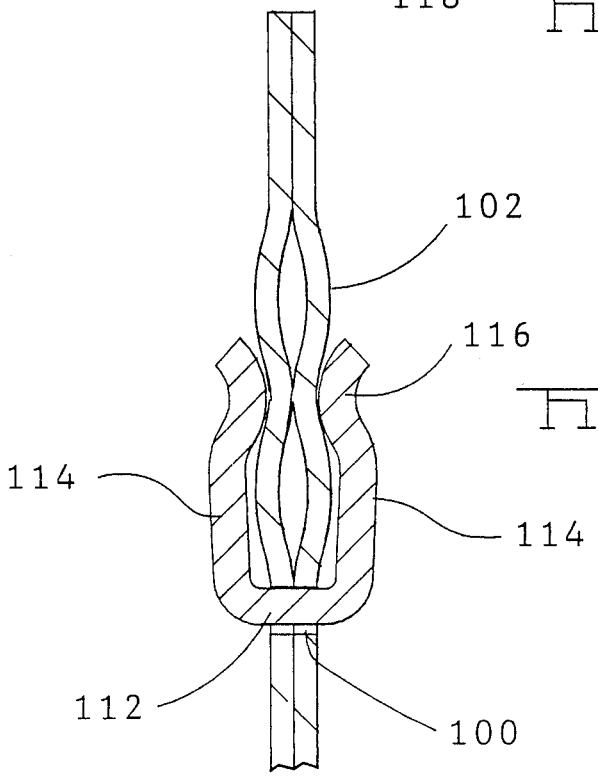
FIG. 26 is a view looking in the direction of the arrows 26—26 of FIG. 15 and showing the connecting device of FIG. 25 coupled to the bus bar.
Figure 27:
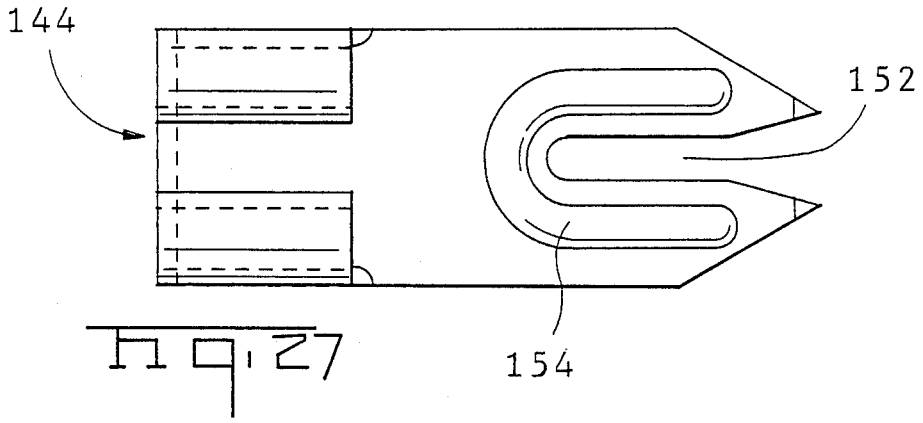

At least one cable wire connecting site 96 is provided for a connecting device 98 on the outer ends 88 of the side walls 86. Each connecting site 96 comprises aligned slots 100 which extend inwardly from the outer ends 88 and a pair of spaced-apart embossments 102 which extend parallel to the slots 100. The manner in which the connecting devices are coupled to the bus bar 82 is described below and shown in FIG. 26.

The bus bar 82 is produced from a flat blank 82', FIG. 19, by stamping parallel slots 104 in the blank between the side edges thereof and sharing the blank along share lines 106 which extend between the slots. The blank is then bent into the form shown in FIG. 18 so that the material on each side of the shear lines 106 form the divergent ears 94. The forming process should be carried out in a manner which will produce severe work hardening in the bight 84 in order that the side walls 86 may function as stiff springs as will be briefly described below.

Figure 24:
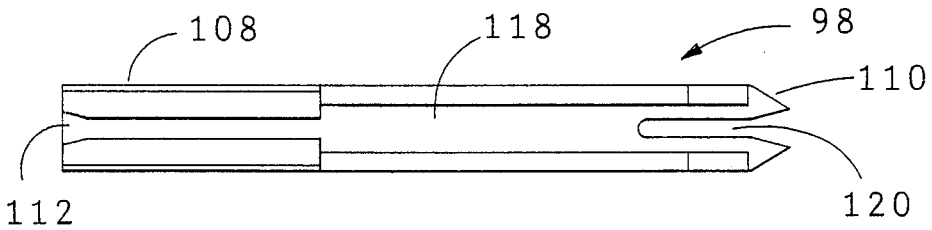
FIG. 24 is a frontal view of a connecting device used with the bus bar of FIG. 15.
Figure 25:
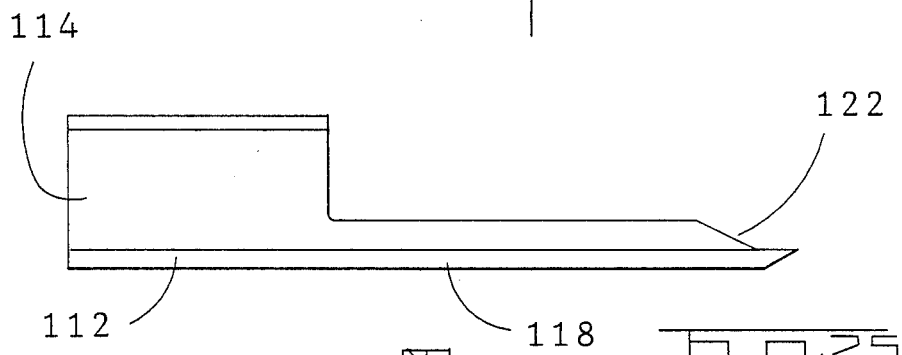
FIG. 25 is a sectional view looking in the direction of the arrows 25—25 of FIG. 24.

The connecting device 98 (FIGS. 24–26) is of stamped and formed sheet metal and has an end, 108, which is coupled to the bus bar and an end 110 which is connected to the wire. The end 108 has a web section 112 from which side walls 114 extend. These side walls are inwardly formed at their outer ends as shown at 116. The device is coupled to the bus bar by moving the web into the aligned slots 100 so that the inwardly formed portions 116 of the side walls lodge in the depressions between the spaced-apart embossments 102.

The side walls are of reduced height in the intermediate portion 118 of the connecting device and are tapered adjacent to the end 110 as shown at 122. A wire receiving slot 120 extends inwardly from the end 110 and the web is pointed on each side of this slot to facilitate penetration of the insulation of the cable when the bus housing subassembly 38 is assembled to the cable clamping subassembly 36.

The bus bar 80, FIGS. 20–23 is of a heavier gauge sheet metal than the bus bar 82 for the reason that it is intended for use with the coarse gauge conductors in the cable and will therefore carry a higher current. This bus bar has a bight 124 from which the side walls or arms 126 extend tangentially. The receptacle sites 130 are formed as described above, that is by punching spaced-apart slots 140 in the flat blank 80' and sharing the material between the slots as shown at 142. When the blank is bent into the shape of FIGS. 21 and 22, the ears 134 will be flexed outwardly and the opening 132 for the male tab will be produced.

The cable wire connecting sites comprise relatively wide aligned slots or openings 136 which extend inwardly from the ends 128 of the side walls 126. Flanges 138 extend outwardly from the sides of the slots for cooperation with the terminals or connecting devices (FIGS. 27–29) which are coupled to the bus bar.

Figure 28:
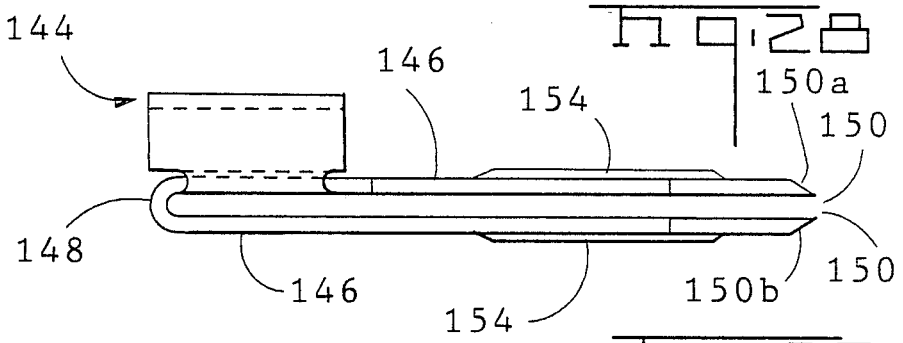
FIGS. 28 and 29 are side and top views of the connecting device shown in FIG. 27.
Figure 29:
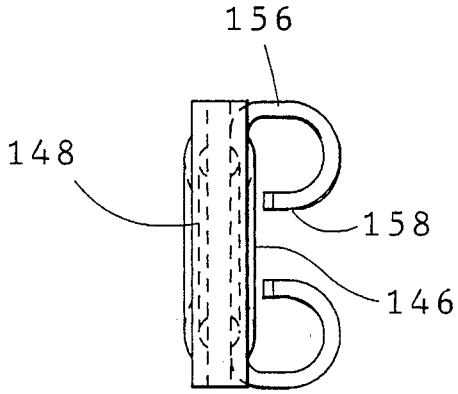
Figure 30:
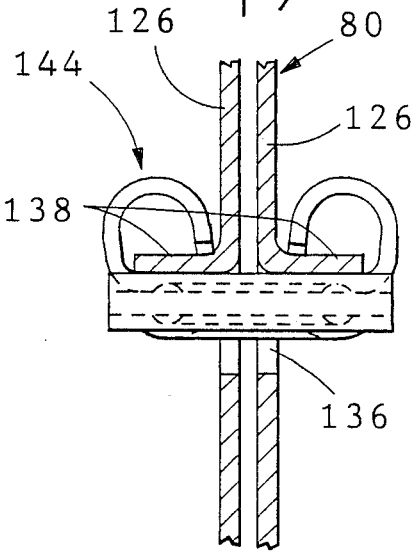
FIG. 30 is a sectional view showing the connecting device of FIG. 27 coupled to the bus bar of FIG. 20.
Figures 11, 12, 17:
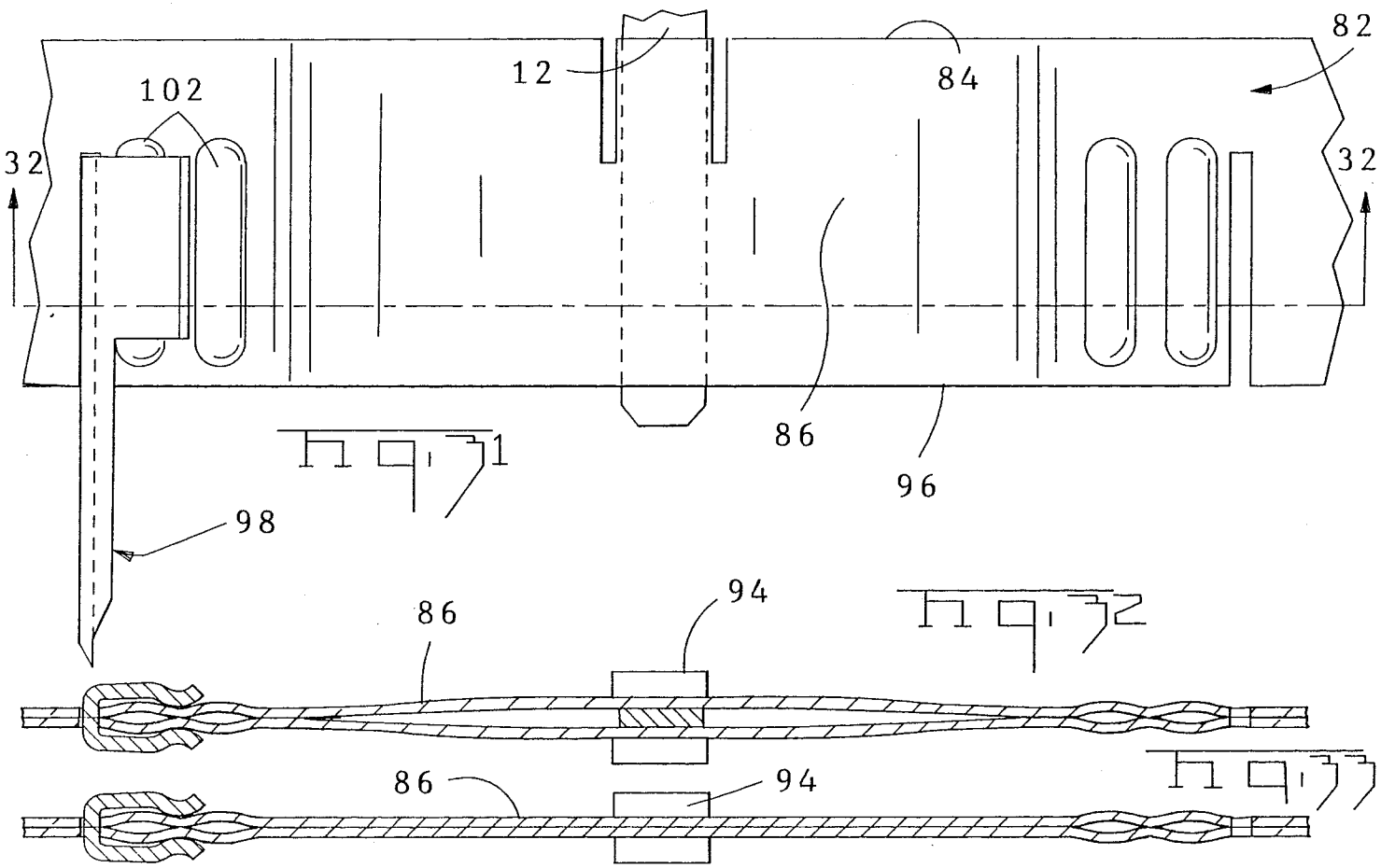
Figure 14:
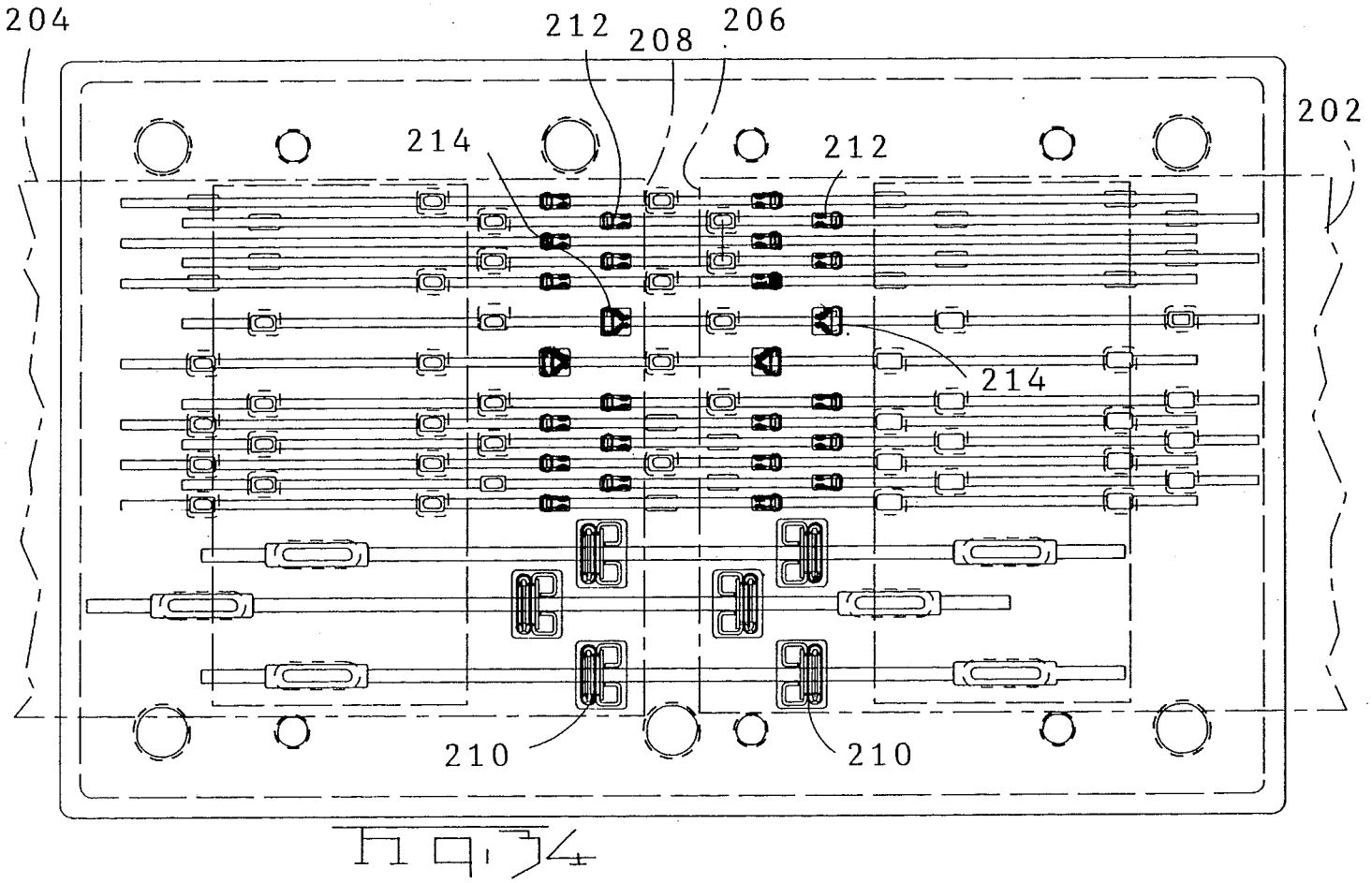

The connecting device 144 (FIGS. 27–30) comprises parallel plate-like members 146 which are joined to each other by a reversely bent portion 148 at their upper ends as viewed in FIG. 28. The ends of the plate-like members are pointed as shown at 150 and each plate-like member has a wire-receiving slot 152. Advantageously, the plate members are embossed as shown at 154 adjacent to the wire-receiving slots for added stiffness. The upper portions of each connecting device are connected to the bus bar by means of ears which extend from the plate-like member on the left shown in FIG. 28. Each ear 156 is reversely curled as shown at 158 so that its end is spaced from the surface of the associated plate member 146. The connecting device 144 can be coupled to its associated bus bar by moving the reversely bent section 148 into the aligned slots in an orientation such that the flanges are received between the ends of the ears 158 and the adjacent surface of the plate member 146 in the manner of a conventional quick disconnect electrical terminal.

As with a conventional quick disconnect terminal the ears 158 contact the planar members, in the form of flanges 138, along the edges thereof. Thus the contact area between flanges 138 and the connecting device or terminal 144 is substantially equal to the cross sectional area of the edges of the two ears 158. The wire-receiving slots 152 establish contact with the same wire 4 in cable 10, each establishing a conventional insulation displacement termination to the wire. Intimate metal-to-metal contact between the wire and the edges of the wire receiving slots 152 is thus established. However, the contact area of each termination is dependent upon the thickness of the metal stock from which the terminal is stamped and formed. As a practical matter, the thickness of the metal stock for a terminal employing reversely curled quick disconnect ears 158 and insulation displacement slots 152 will be controlled by the geometry of the reversely curled ears 158. This configuration requires a relatively tight radius in order to generate sufficient contact spring force. For a given material, there is an upper limit on the thickness of the stock which can be formed on a given radius without cracking the metal. In the preferred embodiment of this invention, terminal 144 is formed of cartridge brass having a thickness of 0.017 inch. The ductility of this material permits a terminal having this thickness to be formed as reversely curled ears 158 having an average radius of 0.034 inch.

Both the quick disconnect edge contact and the insulation displacement termination are recognized as establishing reliable electrical contact with minimal constriction resistance and therefore a small temperature rise. The constriction resistance and temperature rise at the point of contact is dependent of the contact area. For an edge termination, such as that formed by dual quick disconnect ears 158, two electrically parallel terminations are formed with a flat plate section by the two edges of quick disconnect ears 158. Although an insulation displacement slot also forms two terminations, the contact area of an insulation displacement termination with a round wire will not be the same as the contact area established between two quick disconnect ears and a flat plate. In other words the reversely curled contact 158 are capable of carrying more current than the termination formed by an insulation displacement slot when the two terminations are established by material having the same thickness. In the instant invention, the terminal 144 is intended for use in terminating 14 gauge wires and is intended to carry 15 to 20 amps. An insulation displacement slot formed of a 0.017 inch thick cartridge brass will not establish sufficient contact area with a 14 gauge wire to carry 15 to 20 amps, even though the corresponding quick disconnect terminations could carry this current without unacceptable temperature rise. For example, UL permits a maximum temperature of 30° C.

To overcome this problem and in order to achieve sufficient contact area for the insulation displacement termination, a second plate member 146 having a second insulation displacement slot 152 is positioned adjacent to a parallel to the plate member 146 on which reversely curled quick disconnect ears 158 are formed. However, this doubling of the contact area will not result in a corresponding reduction of the resistance over the terminal as a whole if there is a reduction in the effective cross sectional area of the current carrying path at some point between the quick disconnect termination and the insulation displacement termination. Terminal 144 is formed in such a way that there will be no such reduction in the cross sectional area between the two termination points. The two parallel plate-like members 146 extend in opposite directions from the quick disconnect ears 156, thus forming alternate current paths, each having a cross sectional area equal to the cross sectional area of the contact material, between the two termination points. The terminal 144 is formed by first forming lateral segments, located adjacent the middle of the blank from which the terminal is formed, upwardly and into the configuration of the ears 156. The blank is then folded to form the reversely bent portion 148 so that the two plate members or legs 148 extend parallel to each other and the wire receiving slots 152 are in alignment. Thus current can flow in two directions between the ears 156 and slots 152 at each end of the terminal 144 with no reduction in the current carrying path.

Although the addition of a second insulation displacement slot 152 in a second plate member 146 does add additional insulation displacement contact area, the two plate members 146 are relatively long and thin. When these plates are forced over an insulated wire, the plates are subjected to forces normal to the plane of the plate like members. When an insulation displacement termination with a 14 gauge wire in a ribbon cable having a continuous web is made, the two plates 146 would be subjected to a force tending to separate the two parallel plates by the buildup of insulation between the plates. In order to prevent this undesirable tendency, beveled edges **150*a* and 150*b* are formed on outwardly facing surfaces of the tips 150** of each plate.

A bus bar of intermediate size 160, FIG. 2, is provided for the conductors 8 in the cable 10 which are of an intermediate gauge and an appropriately sized connecting device is provided for the bus bar 160. The bus bar 160 can be of either type described above and need not therefore be described in detail.

FIGS. 31–33 illustrate the manner in which the bus bar 82 is deflected when a male tab terminal 12 is inserted into one of the receptacle sites. The side walls or arms 86 are flexed outwardly and bowed as shown in FIG. 32 by virtue of the fact that they are constrained by the bight portions 84 on each side of the receptacle sites. Extremely good area contact is achieved as shown in FIG. 32 and a high contact force can be achieved if desired. The force is produced in a large part by the bowing of the side walls but there is to some extent a contribution to the total force by the cantilever flexure of the side walls away from each other. The contributing factors to the total contact force are complex and will depend upon several variables such as the thickness of the material, the hardness, and the degree of work hardening in the bight 84. Advantageously, the parts are designed such that the flexure illustrated in 32 is entirely, or at least substantially, within the elastic range so that when the tab terminal 12 is removed, the parts return to their original positions as shown in FIG. 33.

The receptacle sites in the bus bars are accessible from the major surface 26 through openings 164, 166, 168 which extend to the slots 74, 76, 78 that receive the bus conductors. The slots are slightly enlarged in the vicinity of the receptacle sites as shown at 170, 172 (FIG. 2) in order to permit the side walls of the bus bars to move apart when the male terminals are inserted. Otherwise, the bus bars are closely confined in their respective slots in order that they will be precisely positioned with respect to their associated cable wires.

Cavities of substantial width are provided in the lower surface of the housing body 60 as shown at 174, 176 for the portions of the connecting devices 98, 144 which are mated with the bus bars.

The connecting devices extend from the bus bars to the cable wires and must therefore extend through the clamping section 42 and the retaining plate 62. Suitable openings are therefore provided in the plate as shown at 178, 180, and 182. The upper section 42 of the cable clamping subassembly 36 is also provided with openings 190, 192, 194 at locations where the connecting devices must extend to the individual cable wires. The openings in the plate member 42 and the aligned openings in the cover member 62 thus define internal passageways which extend from the individual contacting sites on the ends of the bus bars to the cable locating means in the cable locating subassembly 36. As shown in FIG. 2, it is necessary to provide recesses 196, 198, and 200 for the end portions of the connecting devices since these end portions extend past the plane occupied by the cable wires.

It is desirable to provide openings as shown at 187, 186, and 188 in the cover plate 62 in order that there will be clearance for the end portions of the male tab terminals if the dimensions of the parts are such that these tab terminals extend past the ends of the side walls of the bus bars. In FIG. 31, the end portion of the tab terminal 12 does in fact extend beyond the ends 96 of the side walls 86 so that an opening in the cover plate would be required.

Figure 4:
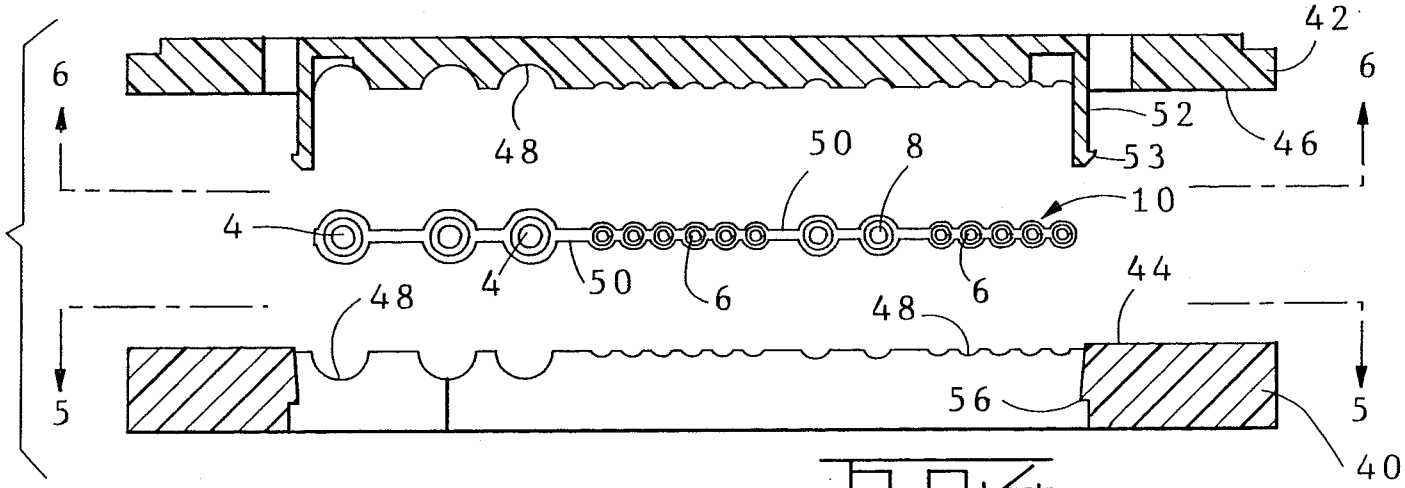
FIG. 4 is a sectional exploded view showing the two sections of the cable clamping and wire locating subassembly.
Figure 1:
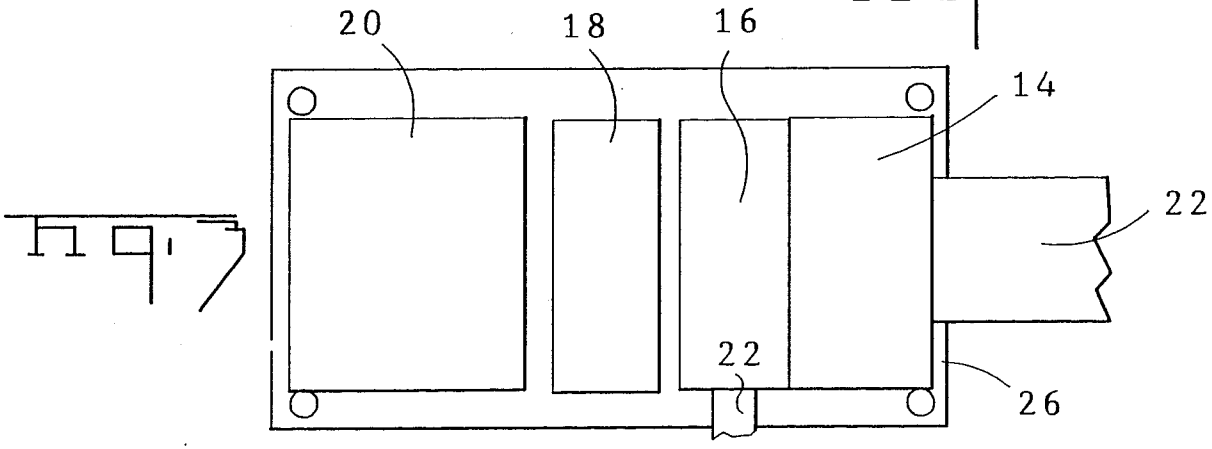
Figure 4:
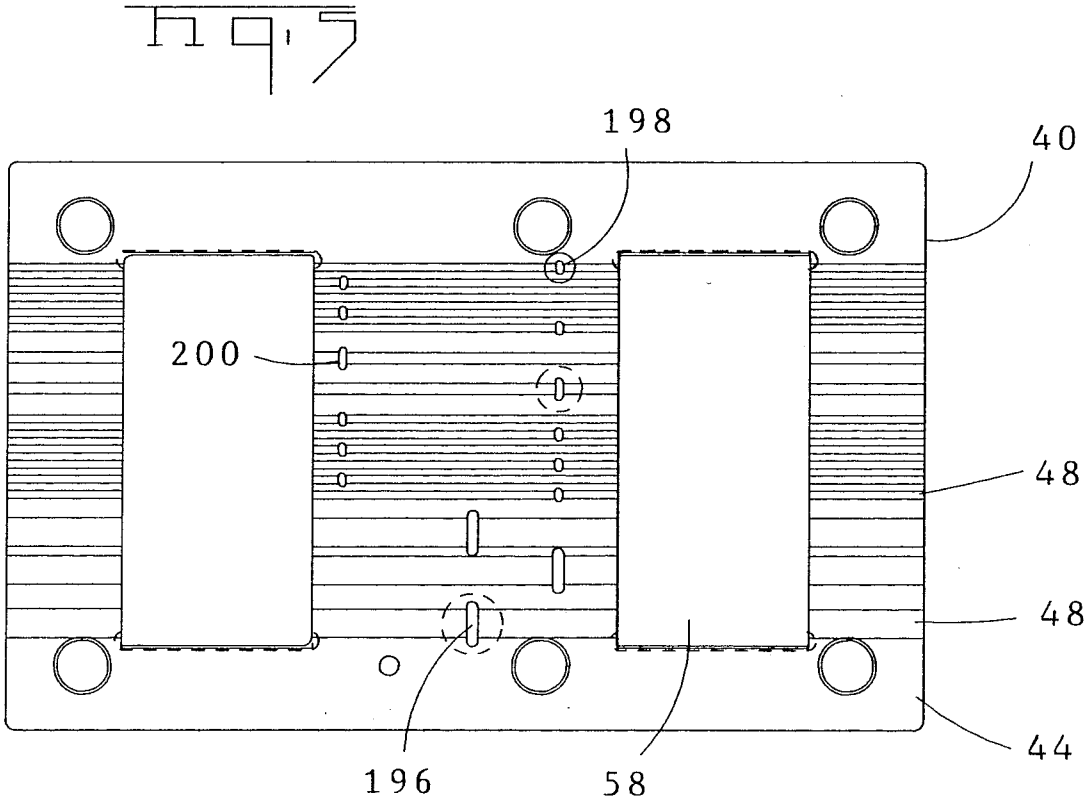
Figure 14:
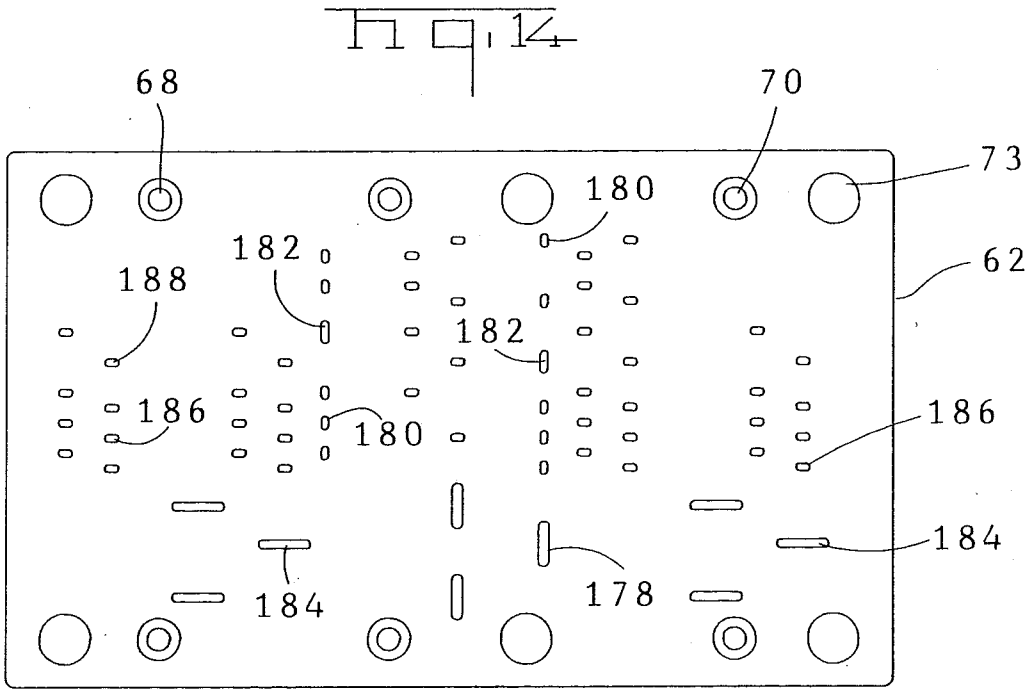
FIG. 14 is a plan view of the cover and retaining plate of the bus housing assembly.
Figures 20, 21, 22, 27:
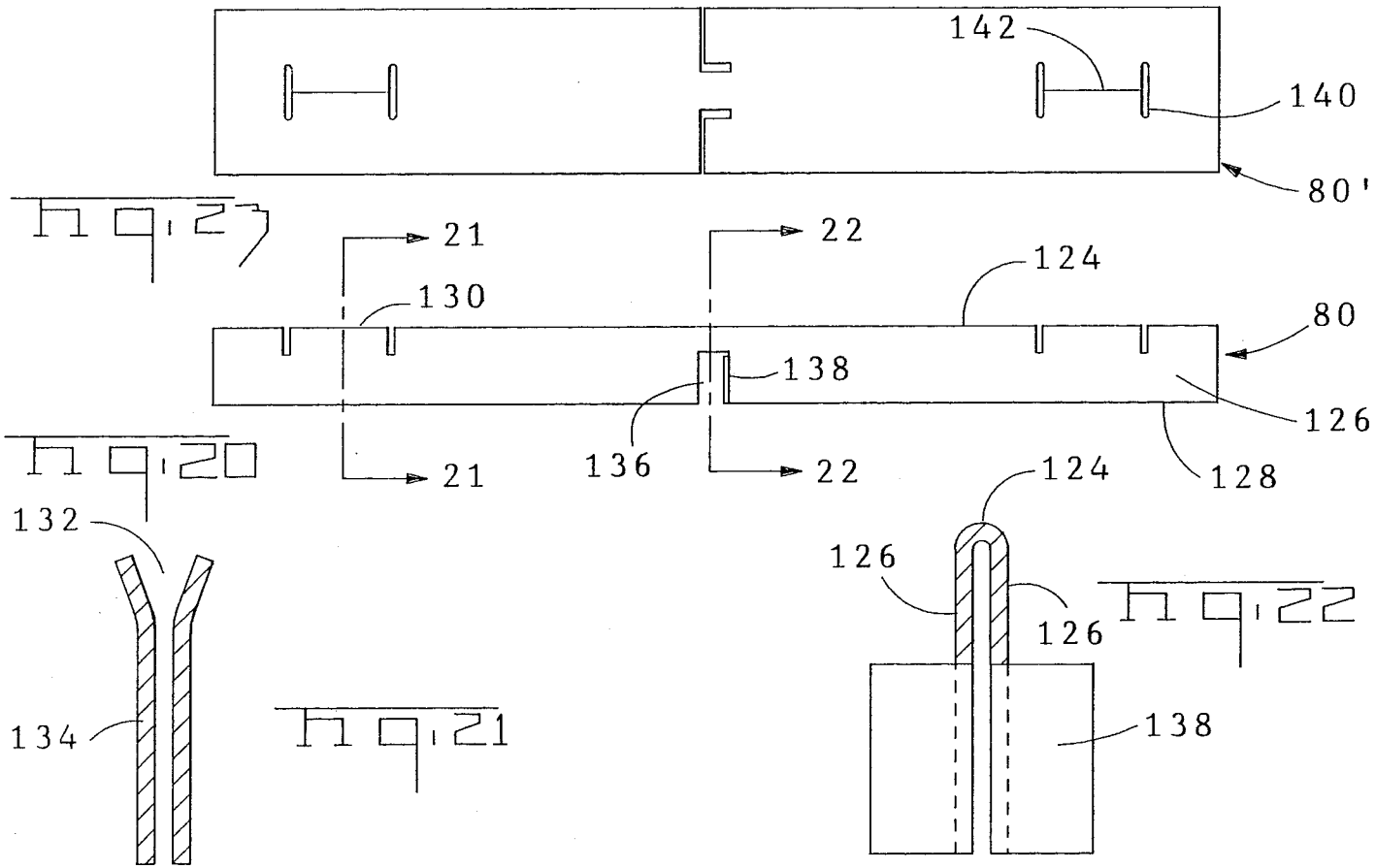
FIG. 20 is a side view of another type of bus bar which is contained in the bus housing.
FIGS. 21 and 22 are sectional views looking in the directions of the correspondingly numbered arrows in FIG. 20.
FIG. 27 is a frontal view of the type of connecting device used with the bus bar shown in FIG. 20.

The cable tap connector 2 is assembled and installed on the cable 10 in the following manner. The cable 10 is first positioned as shown in FIG. 4 between the two sections 40, 42 of the cable clamping subassembly and the two sections are assembled to each other by means of the latch arms 52 so that the cable will be firmly clamped in the subassembly. The individual bus bars 80, 82 and their connecting devices 98, 144 are assembled to the main housing body 60. The cover 62 is then assembled to the housing body 60 and secured in place by fasteners as described above. The two subassemblies 36, 38 are then pressed together so that the connecting devices move through the passageways and penetrate the insulation of the cable 10. The individual cable wires 4, 6, 8 are received in the wire-receiving slots of the connecting devices thereby establishing conducting paths extending from the cable wires to the bus bars as required. Finally, the snap fasteners 72 are assembled to two subassemblies to secure the parts in their assembled relationship. The individual connectors 14–18 can then be mated with the cable connector in the zones on the major surface described above thereby to connect the male tabs extending from the connectors to the cable wires.

FIG. 34 shows in schematic form an alternative embodiment which is capable of forming splice connections between the ends of cables 202, 204 in addition to connections between male tab members and the wires in the cables. In this embodiment, each bus bar has two connecting devices 210, 212, 214 located adjacent to the center of the bus bar so that one of the connecting devices will engage a conductor in the end 206 of the cable 202 and the other connecting device will engage the corresponding conductor in the end 208 of the cable 204 so that the aligned corresponding conductors in the cables will be connected to each other. This feature of splicing the ends of cables can be used independently of the cable tapping capabilities of the system. It should be added, also, that under some circumstances, it may be desirable to provide two connecting devices on each bus bar for making two connections to the cable wires purely for purposes of redundancy.

The bus bars can be of a single thickness of sheet metal rather than being folded as described above. As an alternative, the bus bars can be in the form of a rod or heavy gauge wire. If the rod is a wire, the receptacle sites can be receptacle connecting devices and crimped onto the bus conductors. The connecting devices can similarly be crimped onto a wire-type bus.

The bus bars can, if desired, extend normally of the cable wires rather than parallel to the wires, if desired. The parallel arrangement shown is preferable for the reason, among others, that connections between the individual bus conductors and the wires can be placed at any location along the length of the bus conductor.

The invention can be used under a wide variety of circumstances in which several different types of circuits are required and particularly where different wire gauges are required. For example, in the wiring of a building, the power can be supplied by the coarse gauge wires, communications and control circuits can be connected to the fine gauge wires, and the intermediate gauge wires can be used for emergency circuits (e.g., emergency lighting) which are required in the event of a power failure.

It will be seen from the foregoing description that the invention provides a relatively simple, and therefore reliable, system for making multiple tap connections to single wires in a flat conductor cable. Furthermore, the system is extremely versatile in that the connector receiving zones 28–34 on the major surface 26 can extend across any or all of the bus bars so that the terminal tabs in a single connector can be selectively connected to any of the cable wires. FIGS. 1 and 3 show only one possible arrangement for the connectors and it should be pointed out that any number of individual zones can be provided on the major surface for any number of connectors desired.

I claim:

1. An electrical terminal for establishing an electrical interconnection between a wire and a planar member, the terminal comprising:

a folded plate like member having two parallel legs extending from a reversely bent intermediate section;

a pair of quick disconnect ears folded arcuately upwardly from the edges of one of the legs adjacent the reversely bent intermediate section, the edges of the ears being juxtaposed to the surface of the one leg;

an insulation displacement slot at the end of each of the legs, the slots in the two legs being aligned, the cross sectional area of the legs between the quick disconnect ears and the insulation displacement slot being substantially constant, whereby a planar member can be inserted between the edges of the ears and the one leg and a wire may be terminated between the two aligned slots establishing parallel current paths between the planar member and the wire.

2. The electrical terminal of claim 1 wherein the quick disconnect ears form an open gap adjacent the reversely bent section so that the planar member can in inserted between the ears and the one leg by relative movement of the planar member toward the wire receiving slots.

3. The electrical terminal of claim 2 wherein the ends of the legs are pointed on opposite sides of each wire receiving slot so that the legs can penetrate the insulation of a cable surrounding the wire.

4. The electrical terminal of claim 3 wherein each of the plates is embossed adjacent the slots to increase the stiffness of the legs.

5. An electrical terminal for establishing an electrical interconnection between a wire in an insulated ribbon cable and a planar member, the terminal comprising:

a folded plate like member having two parallel legs extending from a reversely bent intermediate section;

a pair of quick disconnect ears folded arcuately upwardly from the edges of one of the legs adjacent the reversely bent intermediate section, the edges of the ears being juxtaposed to the surface of the one leg;

an insulation displacement slot at the end of each of the legs, the slots in the two legs being aligned, the cross sectional area of the legs between the quick disconnect ears and the insulation displacement slots being substantially constant to form two parallel current paths between the quick disconnect ears and the insulation displacement slots, whereby a planar member can be inserted between the edges of the ears and the one leg and a wire may be terminated between the two aligned slots establishing parallel current paths between the planar member and the wire.

6. The electrical terminal of claim 5 wherein oppositely facing outward surfaces of each leg includes beveled tips on each side of each insulation displacement slot.

7. A stamped and formed electrical terminal having a current carrying capacity of between 15 and 20 amps for establishing an electrical interconnection between a wire having a current carrying capacity of between 15 and 20 amps in an insulated ribbon cable and a planar member, the terminal being formed of cartridge brass having a constant thickness of substantially 0.017 and comprising:

a folded plate like member having two parallel legs extending from a reversely bent intermediate section;

a pair of reversely curled spring members having a thickness of approximately 0.017 folded arcuately upwardly from the edges of one of the legs adjacent the reversely bent intermediate section, the edges of the reversely curled spring members being spaced from the surface of the one leg by a distance less than the thickness of the planar member;

an insulation displacement slot at the end of each of the legs, the slots in the two legs being aligned, the contact area between the wire and edges of the each individual insulation slot being less than the contact area between both of the reversely curled spring members and the planar member, the cross sectional area of the legs between the quick disconnect ears and the insulation displacement slots being substantially constant to form two parallel current paths of substantially equal current carrying capacity between the reversely curled spring members and the wire, whereby a planar member can be inserted between the edges of the spring members and the one leg and a wire may be terminated between the two aligned slots.

8. The electrical terminal of claim 7 wherein the spacing between the two legs is less than the radius of the reversely curled spring members.

9. The electrical terminal of claim 8 wherein oppositely facing outward surfaces of each leg includes beveled tips on each side of each insulation displacement slot.

* * * * *